US006053340A

United States Patent [19]

Cameron

[11] Patent Number: 6,053,340

[45] Date of Patent: Apr. 25, 2000

[54] SPORTS EQUIPMENT STORAGE RACK

[75] Inventor: John L. Cameron, 1322 Bell Ave., Bldg. 1-H, Tustin, Calif. 92780

[73] Assignee: John L. Cameron

[21] Appl. No.: 08/966,189

[22] Filed: Nov. 7, 1997

Related U.S. Application Data

[60] Provisional application No. 60/030,762, Nov. 7, 1996.

[51] Int. Cl.[7] ..... A47F 7/00; A47F 5/08; A47B 73/00; A47K 1/08

[52] U.S. Cl. ..... 211/85.7; 211/75; 211/88.01; 248/311.2; D6/552

[58] Field of Search ..... 211/85.7, 88.01, 211/75, 113; 248/314, 311.2; D6/552

[56] References Cited

U.S. PATENT DOCUMENTS

| | | | |
|---|---|---|---|
| D. 285,147 | 8/1986 | LeCocq, Jr. . | |
| D. 314,302 | 2/1991 | Snow | D6/552 |
| D. 392,081 | 3/1998 | Salvucci, Sr. | 248/311.2 X |
| 1,593,722 | 7/1926 | Joyce | 248/314 |
| 2,005,372 | 6/1935 | Johns | 211/106.01 |
| 2,296,700 | 9/1942 | Branstetter et al. | 211/75 X |
| 3,650,407 | 3/1972 | Benham, Jr. . | |
| 3,698,563 | 10/1972 | Gordon et al. . | |
| 4,116,340 | 9/1978 | Nelson et al. | 211/85.7 |
| 4,193,495 | 3/1980 | Keeley . | |
| 4,227,710 | 10/1980 | Laub . | |
| 4,344,660 | 8/1982 | Molnar et al. . | |
| 4,474,296 | 10/1984 | Hartman | 211/85.7 |
| 4,508,303 | 4/1985 | Beckerer, Jr. | 211/75 X |
| 4,629,065 | 12/1986 | Braaten . | |
| 5,016,794 | 5/1991 | Beagle, Jr. | 211/60.1 X |
| 5,027,960 | 7/1991 | Rainville | 211/85.7 X |
| 5,085,327 | 2/1992 | Mercer, Jr. et al. . | |
| 5,135,195 | 8/1992 | Dane | 248/311.2 |
| 5,294,005 | 3/1994 | Hedges | 211/85.7 |
| 5,337,907 | 8/1994 | McKenzie et al. | 211/88.01 |
| 5,377,849 | 1/1995 | Martin . | |
| 5,413,228 | 5/1995 | LeClerc | 211/13.1 |
| 5,513,758 | 5/1996 | Lin | 211/70.6 |
| 5,567,029 | 10/1996 | Haenisch et al. | 211/75 X |
| 5,785,188 | 7/1998 | Ogden | 211/88.01 |

*Primary Examiner*—Robert W. Gibson, Jr.
*Assistant Examiner*—Erica B. Harris

[57] ABSTRACT

A rack for organizing, protecting, and storing various sports equipment has a backboard, a receptacle for holding a beverage container, at least one equipment hook, a bat holder hook, at least one flexible member such as a securing strap, an optional hanging hole, and a decorative area. The backboard supports the other components and contains points of attachment for the securing strap. The receptacle stores a beverage container in an upright position. The equipment hook allows for hanging sports or related equipment such as baseball gloves or baseball hats. The bat holder hook allows for holding a baseball bat or other equipment such as a jacket or other items of clothing. The flexible member such as a securing strap secures the rack to a fixture such as a chain link fence, wall or other support. The hanging hole allows the rack to be secured to a pre-existing hook or protuberance if the securing straps cannot be used. The decorative area allows for displaying custom graphic matter such as logos or names.

19 Claims, 2 Drawing Sheets

SPORTS EQUIPMENT STORAGE RACK

This application claims benefit of U.S. Provisional Application Ser. No. 60/030,762 filed Nov 7, 1996.

FIELD OF THE INVENTION

The present invention relates to a sports equipment storage rack. More particularly, the present invention relates to a rack that can be used to organize, protect and store baseball and similar sports equipment and apparel in a convenient and easily accessible manner.

BACKGROUND OF THE INVENTION

Devices for storing and organizing sports equipment are used for a variety of purposes, such as transporting the equipment, storing the equipment while not at games, and keeping the equipment organized and easily accessible at the time of a sporting event. But the prior art relating to storage and organization of baseball and other sports equipment is lacking in several respects. Racks known in the art are generally sized to serve the needs of an entire team or at least a multitude of players. A These racks are generally designed to hold several pieces of equipment, such as a large number of bats, balls, or gloves. But an individual may desire to have a personal rack in order to keep personal equipment separate from that of others at games. With team racks, individual pieces of equipment may get lost or misplaced. Accordingly, there is a need to provide a sports equipment rack that can distinguish and separate one person's sports equipment from that of another.

An additional problem with a sports rack directed to an entire team is that the rack is most efficiently used only when the entire team or a multitude of players is assembled. While a team rack allows for convenient organization and storage at the site of the game, once the game is over and the players disperse the rack no longer becomes efficient for the storage of an individual's items. In particular, because the rack is capable of holding items of several players, an individual does not generally have a need for such a rack to store his own personal equipment once he returns home. There is thus need for a rack that can be used by an individual at games as well as at home and at other locations.

Smaller, more personal racks are known in the art, such as bat bags, but these bags are generally bulky and made of fabric, and are therefore difficult to manage and keep organized either at a sporting event or at other locations. Thus, both personal and team sports equipment storage racks known in the prior art generally have the problem of being large, heavy, and difficult to transport to games and use at games in view of the restricted space adjacent the playing field. There is therefore a need for a storage rack that is smaller, lighter, more portable, and easier to transport than the racks found in the prior art.

Because the racks of the prior art tend to be large and difficult to manage, another problem results from the fact that many racks will remain on the ground and create obstructions. This also increases the risk that the equipment will become damaged by people stepping on the equipment or hitting the racks. Accordingly, there is a further need to provide a sports equipment storage rack that does not create an obstruction and that protects the equipment from damage.

A further problem of storage racks in the prior art is that they generally lack the ability to distinguish the particular player or team possessing the rack. In particular, it may be desirable to have a storage rack that can display a team logo, advertisements of sponsors, and items tailored to the individual's own tastes. There is thus a further need for a storage rack that provides a usable display area.

Furthermore, storage racks found in the prior art are generally limited to holding items such as bats or hats or gloves. It is desirable to have racks that have even greater and more versatile storage capabilities. In particular, during sporting events there is often a need to consume beverages to prevent dehydration and to provide nourishment and refreshment. However, baseball dugouts and similar locations often lack a convenient place to put beverage containers. This creates the risk that drinks become misplaced, lost or accidentally spilled. There is thus a need to minimize these risks by providing a storage rack capable of securely holding a beverage container.

SUMMARY OF THE INVENTION

In accordance with the objects of the invention described above, the present invention provides a rack for organizing, protecting, and storing various sports equipment that can be used during the course of a game as well as when the equipment is not in use. The storage rack is made small and light, making it easily portable even for small children. The rack is tailored to the storage needs of an individual, allowing the individual to easily identify the equipment belongs to him, and also allowing the individual to use the rack at a sporting event as well as at home. The rack provides hooks for holding equipment such as a bat, glove and hat, and also contains a receptacle for holding a beverage container. The rack is kept out of harm's way by at least one fastener that allows for easy and simple attachment to a structure such as a fence, wall, or other fixed location, selected by the user and therefore, off the ground and at a personal, convenient location. Because the rack is small and elongated in shape, there is reduced blockage in the event that the rack is interposed between a spectator and the sports players. The storage rack also provides areas for personalizing the rack with information such as advertisements, team logos, and names in order to distinguish the rack from that of others, thereby minimizing the risk that equipment will become misplaced or lost.

More particularly, the rack according to the present invention advantageously includes a backboard, a receptacle for holding a beverage container, two equipment hooks, a bat holder hook, two top securing straps, an optional bottom securing strap, an optional hanging hole, and a decorative area. The backboard provides a means for supporting the other components of the storage rack and contains points of attachment for the securing strap. The receptacle provides a means for storing a beverage container in an upright position. The equipment hooks provide a means for hanging sports or related equipment such as baseball gloves and baseball hats. The bat holder hook provides a means for holding a baseball bat or other equipment such as a jacket or other items of clothing. The top and bottom securing straps provide a means for securing the rack to another fixture such as a fence. The hanging hole provides a means for securing the rack to a pre-existing hook or protuberance if the securing straps cannot be used. The decorative area provides a means for displaying custom graphic matter such as logos or team names that can be added at the time of manufacturing or added later. The decorative area also comprises a nameplate area that provides a means for the owner of the storage rack to display his ownership by either writing his name on a label and affixing the label to the nameplate or by imprinting the nameplate directly with a graphic solution such as ink or paint.

The backboard is preferably flat and made of a rigid material such as metal or plastic. The receptacle is preferably shaped like half of a tubular oval section with sufficient diameter to accommodate a cylindrical beverage container and is made of a rigid material such as metal or plastic. The receptacle is joined to the backboard. The equipment hooks are preferably protuberances and made of a rigid material such as metal or plastic. The equipment hooks are joined to the receptacle. The bat holder hook is preferably U-shaped and has sufficient space between the two protuberances to accommodate the diameter of the handle of a baseball bat. The bat holder hook is preferably made of a rigid material such as metal or plastic and is joined to the backboard below the receptacle. The top securing straps are preferably made of a flexible material such as cloth, plastic, or metal chain and are attached to the top of the backboard at the left and right comers. The straps have a hook at the end to provide a means of attaching the storage rack to a fence or similar fixture. The optional hanging hole is included at the top of the backboard to allow a means of hanging the storage rack on fixtures that do not allow use of the securing straps. The decorative area is preferably made of a rigid material such as metal or plastic and is attached to the backboard after being customized through printing or a related graphic process. The nameplate area may be made of a rigid material such as metal or plastic or can be made of a flexible substance such as paper, vinyl, or related label materials.

In operation, the storage rack is secured to a fixture, such as a chain link fence, with the securing straps. The receptacle is used to store a beverage container in an upright position. The equipment hooks are used to store sporting equipment such as a baseball glove and baseball hat. The bat holder hook is used to store a baseball bat or any other piece of equipment. The decorative area is used to promote or display graphic images that can be added at the time of manufacturing or added later. The nameplate is used as a place for the owner of the storage rack to display his ownership by either writing his name on a label and affixing the label to the nameplate, or by imprinting the name plate directly with a graphic solution such as ink or paint.

DETAILED DESCRIPTION OF THE PREFERRED EMBODIMENT

Figure 1:
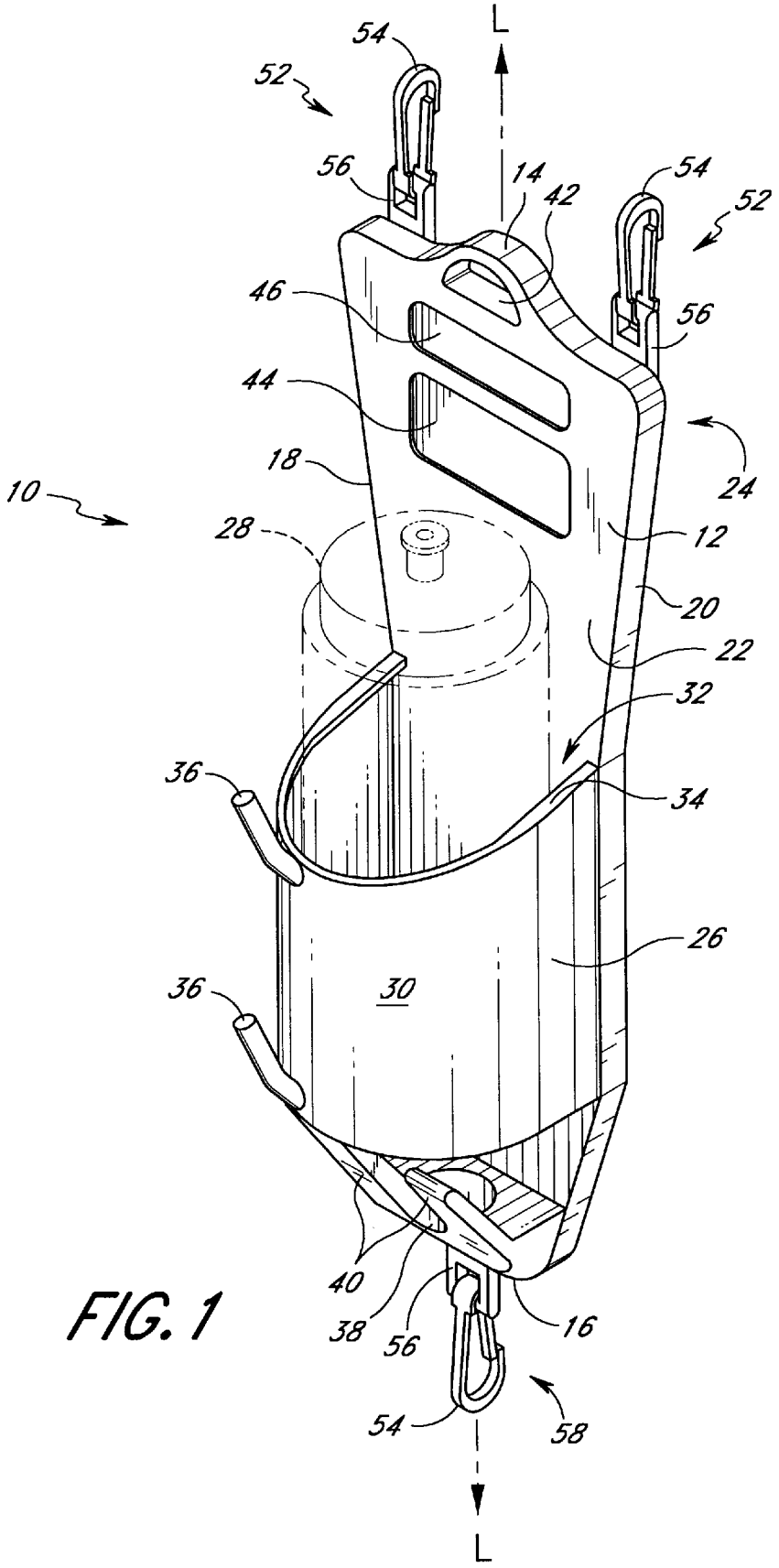
FIG. 1 is a perspective view of the sports equipment storage rack of the present invention.
Figure 2:
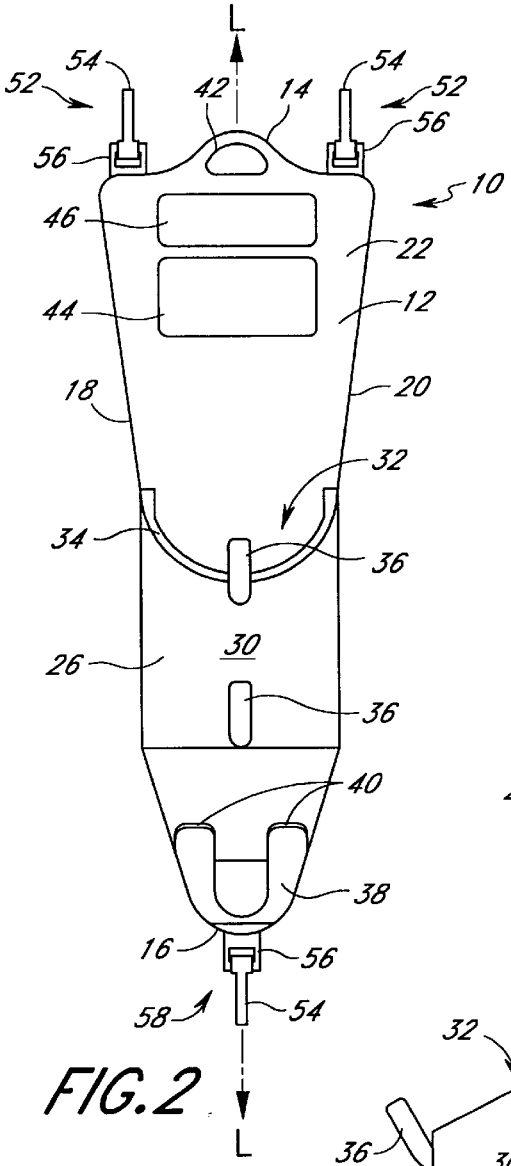
FIG. 2 is a front elevational view of the sports equipment storage rack of the present invention.

Referring to FIGS. 1–6, there is illustrated a sports equipment storage rack 10. As shown in FIG. 1, the storage rack includes a back support or backboard 12, which serves as the point of attachment for other components of the storage rack. The backboard 12 is vertically oriented in use and has an upper edge 14, a lower edge 16, opposing side edges 18 and 20, a front side or surface 22, and a back side or surface 24. The backboard 12 advantageously has a flat front side 22. The peripheral edges of the backboard 12 may be flanged in a direction perpendicular to the front side 22 in order to provide increased rigidity and strength and lighter weight. The backboard 12 is advantageously made of a rigid material such as metal or plastic. Plastic is especially useful because it keeps the storage rack light and it is easy and inexpensive to mold into desired shapes. The backboard advantageously has an elongated shape, such as a generally rectangular shape with a vertical height dimension greater than a width dimension. This elongated shape provides added stability against rotation about a generally horizontal axis when the rack is used as described herein. In the embodiment shown in FIG. 1, the backboard 12 has a vertical height dimension of approximately 18 inches and a width dimension of approximately 6 inches.

Joined to the front side 22 of the backboard 12 is a receptacle 26 for holding a beverage container 28. The receptacle 26 has an outer surface 30, the outer surface 30 advantageously having a convex shape. Preferably, the receptacle 26 has an interior cavity 32 advantageously shaped and sized to conform to the shape of the beverage container. For a cylindrical beverage container, the cavity 32 comprises a tubular section of sufficient internal diameter to accommodate the cylindrical beverage container. The receptacle 26 is advantageously made of a rigid material such as metal or plastic, but plastic is especially useful for weight and manufacturing advantages. The center of the upper edge 34 of the receptacle advantageously has a curved shape, curving toward lower edge 16 to form an oval entrance when viewed from the front as in FIG. 2. This shape allows easy access to the cavity 32 when inserting the container.

Although the receptacle 26 has been described as having an outer surface and an interior cavity with a tubular section, it should be recognized that the receptacle can also take on other shapes. For example, the receptacle can comprise a plate with a hole extending therethrough for holding a tapered beverage container. Alternatively, the receptacle can comprise a shelf having sides for retaining a beverage container.

A plurality of equipment hooks, such as the two equipment hooks 36, are attached to the outer surface 30 of the receptacle 26. The equipment hooks 36 are advantageously located in a plane through longitudinal axis L—L of the backboard 12 and perpendicular to the backboard 12. The equipment hooks 36 are advantageously adapted to be used to hang equipment such as baseball hats, baseball gloves, or other items such as towels, jackets and other apparel. Placing the equipment hooks on the outer surface 30 of the receptacle 26 has the advantage of saving space to make the design more compact. It also reduces the amount of blockage in the event the rack 10 is interposed between a spectator and sports players.

The rack 10 is advantageously elongated as the distance between the opposing top and bottom edges 14, 16 of back support or backboard 12 is substantially greater than the distance between opposing sides 18, 20 of the backboard 12. Advantageously, the distance between the opposing top and bottom edges 14, 16 of backboard 12 is at least three times greater than the distance between opposing sides 18, 20 of the backboard 12. The elongated vertical configuration also reduces the effective blockage and allows spectators to see around the rack 10. The described location of the equipment hooks 36 also reduces the tendency of the rack 10 to rotate in the plane of the backboard 12. It should be recognized, however, that the equipment hooks 36 may also be located in positions on the front side 22 of the backboard 12 or at other positions on the receptacle 26. These equipment hooks 36 are advantageously made of a rigid material such as metal or plastic, with plastic being especially useful to minimize the weight of the rack and allow easy manufacturing by molding.

A slotted bat holder hook 38 extends from the backboard 12 below the receptacle 26 extending from the lower edge 16. The bat holder hook 38 has an open ended slot into which a baseball handle may be inserted so the hook 38 holds the bat. Advantageously, the bat holder hook 38 is formed by a U-shaped hook 38 having two protuberances 40 spaced apart to form a slot, with the spacing sufficient to accommodate the diameter of the handle of a baseball bat. The protuberances 40 advantageously curve upward toward edge 14 to retain the bat securely. The bat holder hook 38 is advantageously made of a rigid material such as metal or plastic, with plastic being especially useful to minimize the weight of the rack and to facilitate manufacturing by molding. The bat holder hook 38 is also advantageously centered on a plane extending through axis L—L and equipment hooks 36.

One or more decorative areas 44, 46 are provided on the front side 22 of the backboard 12, preferably above the receptacle 26, and advantageously so that the areas are visible when a beverage container 28 is placed in the receptacle 26. Printed indicia and decorative materials can be placed on or attached to the areas 44, 46 by adhesives, hook and loop fasteners, threaded fasteners, or other known fastening means. Decorative areas 44, 46 can comprise space for printed indicia. The decorative area 46 advantageously comprises a nameplate area for the name of the user. While the areas 44, 46 are advantageously placed so that the areas are visible when a beverage container 28 is placed in the receptacle 26, the container 28 may block a portion of the printed indicia if desired. The areas 44, 46 are advantageously formed integrally with backboard 12. While the printed indicia can also be integrally molded it is advantageously added later by the user or others.

The storage rack 10 also provides a fastener for hanging the rack to a structure. The fastener includes a hanging hole 42, located adjacent the upper edge 14 of the backboard 12, and extending through backboard 12. This hanging hole 42 enables the rack 10 to be hung on nails, pegs, or other protuberances on supports or fixed locations such as a wall or fence.

Figure 3:
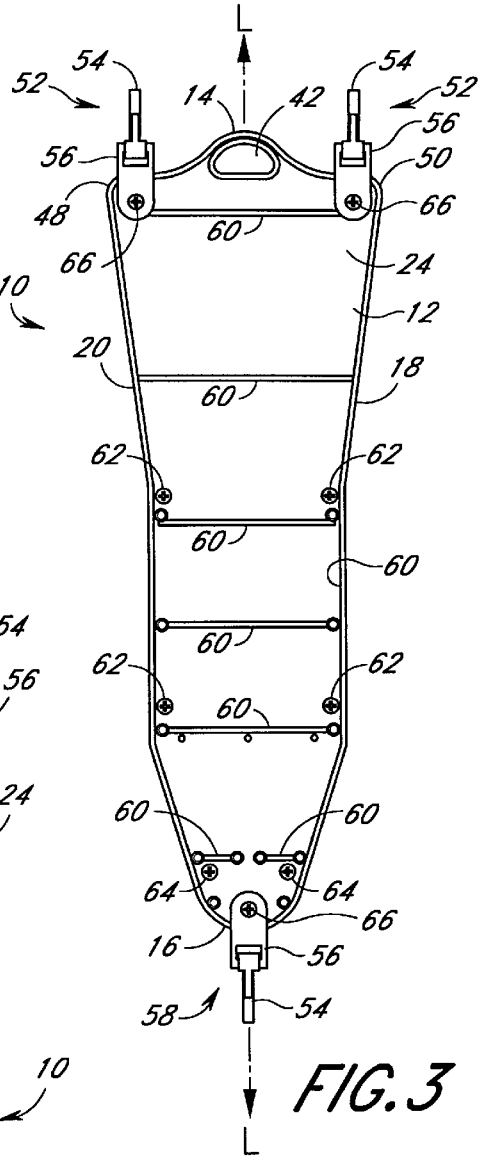
FIG. 3 is a rear elevational view of the sports equipment storage rack of the present invention.
Figure 5:
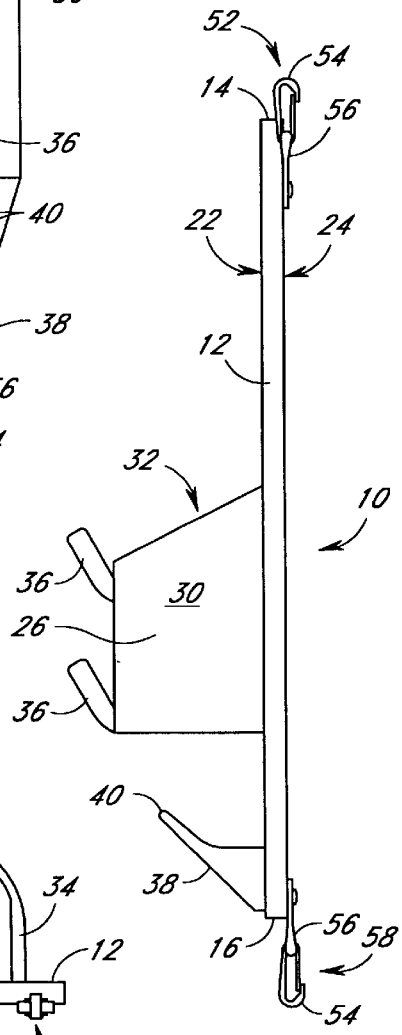
FIG. 5 is a side elevational view of the sports equipment storage rack of the present invention.
Figure 4:
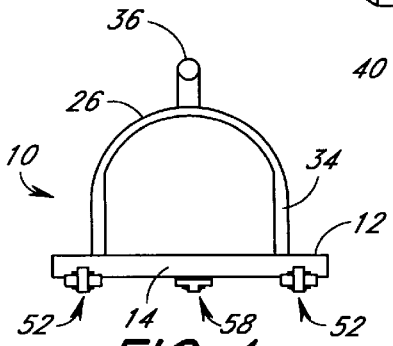
FIG. 4 is a top plan view of the sports equipment storage rack of the present invention.
Figure 6:
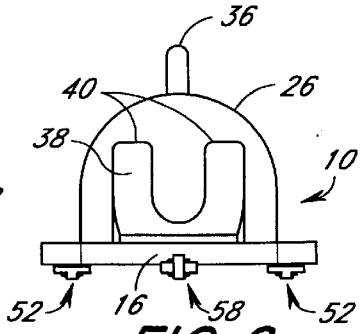
FIG. 6 is a bottom plan view of the sports equipment storage rack of the present invention.

As shown in FIG. 3, the fastener also includes flexible members which are connected to opposing comers of the rack 10. On the back side 24 of the storage rack 10, when viewed from the back as in FIG. 3, there is an upper left comer 48 and an upper right comer 50. Two flexible members such as securing straps 52 are provided, one at each of the comers 48 and 50. The securing straps 52 are advantageously made of a flexible material such as chain, cloth, plastic, or metal. FIG. 3 shows securing straps 52 made of plastic. The securing straps 52 are connected to the backboard 12. The connection may be by looping the securing straps 52 through holes in the backboard 12, or by a threaded fastener 66 extending through the straps 52 into the backboard 12, or by adhesives, hook and loop fasteners, or other means known to one skilled in the art.

As shown in FIG. 3, the securing straps each have a securing hook 54 to provide a means for attaching the storage rack to a chain link fence or similar fixture. The securing straps 52 also include a flexible member 56 connected to the securing hook 54 which is attached to the comers 48, 50 of the backboard 12. This flexible member 56 may be removed when use of the securing straps is not necessary, e.g., when the hanging hole 42 is used to hang the rack.

Although the securing straps 52 shown in this embodiment are fixed to the upper comers 48, 50 of the back side 24 of the backboard 12, it should be recognized that the securing straps 52 can be connected at any suitable location, including the front side of the backboard, in order to hang the rack 10.

The backboard 12 is advantageously molded out of plastic material, with suitable stiffening ridges or flanges 60 located on the back side 24 of the backboard 12. The number of ridges 60 depends on the proportions of the rack 10, and can be located in a variety of locations on the back side 24. Thus, the ridges do not have to be configured as shown as in FIG. 3. The receptacle 26 and equipment hooks 36 are advantageously integrally molded as a single piece of plastic and then connected to the backboard 12. The connection will vary with the material of construction, but for a plastic receptacle 26 the connection is advantageously achieved by adhesives or threaded fasteners 62 extending from the backboard 12 into the edges of the receptacle 26. The bat holder hook 38 is advantageously molded as a separate piece of plastic and then connected to the backboard 12. The connection will vary with the material of construction, but for a plastic hook 38, the connection is advantageously achieved by adhesives or threaded fasteners 64 extending from the backboard 12 into the edges of the bat holder hook 38. The beverage container 28 may be separately provided, but advantageously comprises a container molded of plastic with a removable cap to allow refilling and to allow access to the contained fluids. The container 28 may have a pop-up spout for easy drinking.

There is thus provided a portable rack 10 that has a backboard 12 that is advantageously elongated and substantially flat. A beverage container holder or receptacle, a plurality of hooks, and a U-shaped equipment holder are provided, all of which are advantageously located in a plane through the centerline of the back plate and perpendicular to the back plate. When hung on a fence or wall, the hooks and equipment holder provide a stable support for sports equipment which reduces blockage in the event the holder is interposed between a spectator and the sports players. The support can be readily mounted at a predetermined location suitable to the user for personal use.

There is advantageously provided a fastener to removably connect the rack 10 to a structure such as a fence or wall or other support. The fastener can comprise the securing straps 52 at the upper end of the rack 10 to provide a readily removable means for attaching the rack 10 to a structure, such as a chain link fence, wall or other support. The fastener can also comprise the hanging hole 42 which cooperates with a hook, projection or other connector interposed between the hanging hole 42 and the rack 10 to connect the rack to a structure such as a fence or wall.

A bottom securing strap 58 helps stabilize the rack 10 against rotation in the plane of the backboard 12, although the bottom strap 58 can be omitted. When rack 10 is removably connected to a support at the upper edge 14, the rack 10 will have its lower end 16 urged against the support to stabilize the rack 10. As equipment is hung from the hooks 36, 38, the weight of the equipment will further stabilize the rack 10.

Thus, preferred embodiments of the invention have been illustrated and described with reference to the accompanying drawings. Those skilled in the art will understand that these preferred embodiments are given by way of example only. Various changes and modifications may be made without departing from the scope and spirit of the invention, which is intended to be defined by the appended claims.

What is claimed is:

1. A portable sports equipment storage rack that is releasably connectable to a structure, comprising:

a back support having opposing upper and lower edges, opposing side edges, and opposing front and back surfaces;

a receptacle connected to and extending from the front surface of the back support, the receptacle having an outer surface and having an inner surface defining a cavity that is sized and configured to securely receive a beverage container;

at least one equipment hook connected to the outer surface of the receptacle, the equipment hook being of sufficient size so that sports equipment can be hung from the hook;

a slotted support located below the receptacle and connected to and extending from the front surface of the back support configured to receive the handle of a baseball bat; and a fastener adapted to connect to the back support to hold the rack from the structure.

2. The storage rack of claim 1, wherein the back support is elongated with the distance between the opposing upper and lower edges being substantially greater than the distance between the opposing side edges.

3. The storage rack of claim 1, wherein the equipment hook connects to the receptacle in a plane that extends through a longitudinal axis of the back support and is perpendicular to the front surface.

4. The storage rack of claim 1, wherein the fastener comprises a hole in the back support.

5. The storage rack of claim 1, wherein the fastener comprises at least one flexible member.

6. The storage rack of claim 1, wherein the front surface includes a decorative area for displaying printed indicia.

7. The storage rack of claim 1, wherein the at least one equipment hook comprises two equipment hooks each connected to the receptacle in a plane that extends through a longitudinal axis of the back support and is perpendicular to the front surface.

8. The storage rack of claim 7, wherein the fastener comprises a hole in the back support.

9. The storage rack of claim 8, wherein the front surface includes a decorative area for displaying printed indicia with at least a portion of the decorative area being located intermediate the upper edge of the back support and the beverage container receptacle.

10. The storage rack of claim 9, wherein the back support is elongated with the distance between the opposing upper and lower edges being substantially greater than the distance between the opposing side edges.

11. A method of manufacturing a sports equipment storage rack, comprising the steps of:

providing a back support having opposing upper and lower edges and opposing front and back surfaces;

providing a receptacle connected to and extending from the front surface of said back support, the receptacle having an outer surface and having an inner surface defining a cavity that is sized and configured to securely receive a beverage container;

providing at least one equipment hook connected to the outer surface of said receptacle, the equipment hook being of sufficient size so that sports equipment can be hung from the hook;

providing a slotted support located below said receptacle and connected to and extending from the front surface of said back support configured to receive the handle of a baseball bat; and providing a fastener adapted to connect to said back support to releasably connect the rack to a structure.

12. A sports equipment storage rack, comprising:

a support structure;

a receptacle connected to and extending from the support structure, the receptacle having an outer surface and an inner surface defining a cavity shaped and sized to conform to the shape of a beverage container;

at least one equipment hook connected to the outer surface of the receptacle; and a support hook located below the receptacle and connected to and extending from the support structure configured to receive a piece of sports equipment.

13. The storage rack of claim 12, wherein the inner surface of the cavity is at least partially cylindrical in shape to receive a substantially cylindrical beverage container.

14. The storage rack of claim 12, wherein the receptacle has an upper edge with a curved shape.

15. The storage rack of claim 12, wherein the receptacle is made of a rigid material.

16. The storage rack of claim 12, wherein the support hook is substantially U-shaped.

17. The storage rack of claim 12, wherein the support structure is a back support having opposing upper and lower edges, opposing side edges, and opposing front and back surfaces.

18. The storage rack of claim 17, wherein the back support is elongated with the distance between the opposing upper and lower edges being greater than the distance between the opposing side edges.

19. The storage rack of claim 17, wherein the front surface includes a decorative area for displaying printed indicia.

* * * * *